United States Patent [19]

Mozley

[11] 4,148,723

[45] Apr. 10, 1979

[54] CYCLONE SEPARATOR

[75] Inventor: Richard H. Mozley, Falmouth, England

[73] Assignee: National Research Development Corporation, London, England

[21] Appl. No.: 887,047

[22] Filed: Mar. 16, 1978

Related U.S. Application Data

[63] Continuation of Ser. No. 762,515, Jan. 26, 1977, abandoned.

[30] Foreign Application Priority Data

Jan. 28, 1976 [GB] United Kingdom ..... 03300/76

[51] Int. Cl.[2] ..... B04C 5/28

[52] U.S. Cl. ..... 209/211; 210/512 M

[58] Field of Search ..... 209/144, 211; 210/512 R, 84, 512 M, 85, 91, 93; 55/459 R, 349, 274, 282, DIG. 34, 283, 296, 432, 433, 428; 15/3, 93 R, 67, 104.05, 104.02, 104.06 A; 6/10, 11, 12 A; 222/149, 52, 70

[56] References Cited

U.S. PATENT DOCUMENTS

| | | | |
|---|---|---|---|
| 2,534,702 | 12/1950 | Driessen | 55/428 X |
| 2,765,918 | 10/1956 | Fontein et al. | 210/512 M X |
| 2,848,066 | 8/1958 | Allander et al. | 55/296 |
| 2,882,022 | 4/1959 | Greathouse et al. | 15/104.05 X |
| 2,897,972 | 8/1959 | Cannon | 210/512 R |
| 3,417,871 | 12/1968 | Arnold | 210/512 R |
| 3,771,365 | 11/1973 | Schempp | 55/274 X |

FOREIGN PATENT DOCUMENTS

| | | | |
|---|---|---|---|
| 255184 | 7/1924 | Fed. Rep. of Germany | 6/12 A |
| 1470331 | 1/1967 | France | 15/67 |
| 739504 | 11/1955 | United Kingdom | 55/296 |

*Primary Examiner*—Ralph J. Hill

*Attorney, Agent, or Firm*—Cushman, Darby & Cushman

[57] ABSTRACT

A cyclone separator has an operative clearing member such as an elongated rod for clearing obstructions in a passage or inlet or outlet section of the cyclone, especially the vortex finder outlet and apex outlet. The elongated rod is disposed outside the cyclone during the normal period of separation and means are provided to insert it, for example through the vortex finder and thereafter through the apex outlet, from outside the cyclone when a clearing action is initiated.

5 Claims, 5 Drawing Figures

CYCLONE SEPARATOR

This is a continuation of application Ser. No. 762,512 filed Jan. 26, 1977 now abandoned.

This invention relates to cyclone separaters such as hydrocyclone separators.

Hydrocyclone separators are customarily used in the form of a battery of separators working in parallel in a common chamber. Such devices have important uses in mineral separation.

One of the problems in the operation of cyclones is the tendency for blockages to occur in passageways and apertures in the apparatus causing not only a partial or complete obstruction of flow, but serious departures from the desired separation conditions. Should a blockage take place, for example, in the inlet to the cyclone, the particular cyclone in which this occurs will stop working. More serious, however, and also more likely, is the case where the blockage takes place in the outlet known as the underflow or apex of the cyclone, from which the denser fraction is recovered, for then the denser (coarser, heavier) fraction is not properly separated and finds its way into the other outlet (known as the overflow or vortex finder) along with the less dense (finer, lighter) fraction. This is most undesirable, especially in the papermaking and clay industries, where there must be absolutely no grit in the overflow.

According to the present invention, a cyclone separator has means, including an operative clearing member, for clearing obstructions in a passage or inlet or outlet (preferably outlet) section of the cyclone, which means is disposed outside the cyclone during the normal period of separation, means being provided to insert the operative clearing member into the desired passage or inlet or outlet from outside the cyclone when a clearing operation is initiated.

The invention also provides a method of clearing a cyclone separator of an obstruction in a passage or inlet or outlet (preferably outlet) section of the cyclone, comprising inserting an operative clearing member into the cyclone from outside the cyclone into the desired passage or inlet or outlet, and then withdrawing the operative clearing member out of the cyclone, the means for inserting and withdrawing the member being at all times disposed outside the cyclone. Previous proposals (as far as is known) to provide clearing systems for dealing with the obstruction problem all required clearing devices of which at least some parts were located within the cyclone during the entire operation of the process. Since clearing devices need only be operated intermittently, they were for the most of the time non-functional in these prior devices yet all the time interfered with the hydrodynamic conditions within the cyclone, making it impossible to achieve optimal conditions for separation.

The primary application of the present invention is to the clearing of the apex outlet of the cyclone. Preferably, the clearing means can also clear obstruction in the overflow or vortex finder outlet of the cyclone. A particularly convenient form of clearing member is that of an elongated pusher rod which is arranged for insertion through the vortex finder and thence through the apex outlet. The cyclone is preferably constructed with the apex sufficiently resilient to allow at least slightly oversized particles to be pushed through it by the clearing member. The apex, for this purpose, may be a thin-walled spigot of polypropylene.

Preferably the clearing system also comprises a device for removing obstructions from the tangential inlet of the cyclone. In apparatus in which the clearing system embraces all the above features it is convenient to set these in operation by an automatic sequential timing system. Where removal of blockages in the cyclone inlet causes them to enter the interior of the cyclone it will be appreciated that the sequence of operations is so timed that clearance of the cyclone inlet precedes clearance of the apex outlet.

Initiation of the clearing operation may thus be by a timer, or else by a blockage sensor. Preferably both are provided and initiation is by either. The blockage sensor may for example be a pressure transducer, pressure-sensitive pad or pneumatic sensor or thermistor or other means located more or less immediately downstream of the passage at risk of blockage, capable of giving a signal in the event of a pressure drop or diminution of fluid flow such as would follow blockage of the passage.

The invention is illustrated by way of example with reference to the accompanying drawings, in which.

Figure 1:
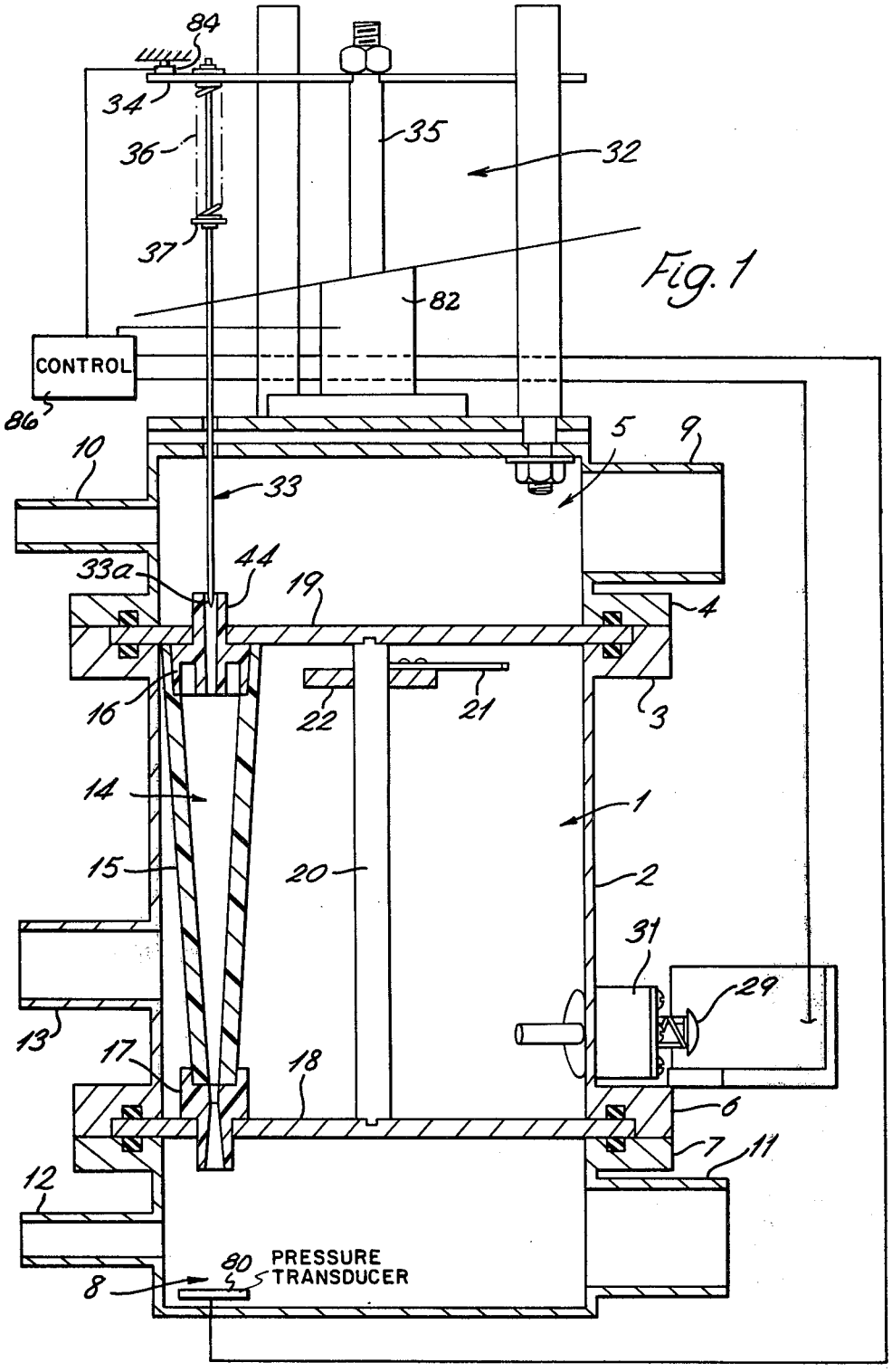
FIG. 1 is a sectional side elevation showing the general layout of a parallel working cyclone system.

Referring now to FIG. 1, the apparatus comprises a central working section indicated generally by reference number 1 comprising a cylindrical body portion 2, terminating in an upper flanged end 3 by which it is bolted to a correspondingly flanged lower end 4 of an uppermost end closure section indicated generally by reference number 5. The lower end of body portion 2 is flanged at 6 where it is bolted to the upper flanged end 7 of a bottom closure indicated by reference number 8.

The upper end closure 5 is provided with an overflow discharge pipe 9 and a breather pipe 10, the bottom end closure 8 having a corresponding underflow pipe 11 and a breather pipe 12. The central section 1 has an inlet feed pipe 13 and houses nine cyclones 14, only one of which is shown in FIG. 1.

Each cyclone 14 is fabricated in three sections in rigid polyurethane and comprises a conical body section 15 fitting at its upper end into a vortex finder cap 16 and at its lower end into an apex unit 17. Vertically below the apex unit 17 there is a pressure transducer 80 which will give a signal if it senses a drop in pressure below what it experiences in normal operation. The three sections 15, 16 and 17 are described in more detail hereafter. The cyclones 14 are supported at their lower end on a circular plate 18 containing a series of spaced apertures which receive the apex units 17. The cyclones are held at their upper end by a circular plate 18 containing corresponding apertures through which the vortex finder caps 16 are inserted. The caps 16 have vortex finders 44. The three sections of the cyclone are machined so as to provide a fluid-tight assembly held together primarily by the pressure with which the end closures 5 and 8 are bolted to the central section 1, this pressure being applied to the cyclones through the circular plates 18 and 19.

Fitting between the plates 18 and 19 and rotatably mounted therein is a central vertical rod 20 which carries at its upper end a swastika-shaped arrangement of clearing prongs 21 which are screwed to a central plate 22 rigidly connected to the rod 20. The prongs 21 extend in a horizontal plane, as seen most clearly in FIG. 2, so that their operative ends are disposed for insertion into the inlet portions 23 of the vortex finders 16 upon rotation of the central rod 20. Actuation of the latter is achieved, as seen best in FIG. 3, by means of an L-shaped linkage 24 connected to the rod 20 at one end actuated at its other end by means of a plunger arrangement 25. The latter consists of a hydraulic or pneumatic cylinder system 26 connected by arms 27 to the flange 6. This operates via a plunger 28 through a further plunger 29 which is spring loaded and which is connected to the linkage 24 and mounted in a housing 30 formed as an integral projection or boss 31 on the body portion 2.

Clearance of an obstruction in the inlet of the vortex finder cap 16 and the apex unit 17 is achieved by means of a mechanism mounted externally to the central section 1. This mechanism is indicated generally by reference numeral 32 and comprises, for each cyclone 14, a long thin rod 33 mounted at its upper end in a plate 34 carried by a central shaft 35 arranged for vertical movement in both directions controlled by a hydraulic or pneumatic system 82 (not shown in detail). The rod 33 has its lower end **33*a* tapered to a point. The plate 34 carries a switch 84**.

The rods 33 extend through apertures in the upper end closure 5 and, in the position shown in FIG. 1, terminate with their lower ends **33*a* slightly inserted into the vortex finders 16, so that during normal operation of the cyclones no component part of the clearing system is within the cyclone itself. Each rod 33 carries a spring 36 which is compressible between a lower pressure pad 37 and a similar pad adjacent to the plate 34. The rods 33 are of sufficient length so that in their lowermost position the tapered ends 33*a* thereof extend sufficiently far into the apex unit 17 to remove any obstruction present therein, and parts of the rod 33 can be (if desired for greater rigidity) nearly as wide as the minimum internal diameter of the vortex finder 44, as long as even in its lowermost position it can extend as aforesaid into the apex unit 17**.

The apparatus operates as follows. A suitable feed, which may be a slurry containing finely ground mineral particles, is passed through a trash screen and then admitted through the inlet pipe 13 into the central working section 1. The trash screen is especially desirable for cyclones of small (e.g. 1" (25.4 mm)) maximum internal diameter, since the cyclone apex then may be of for example 1/16" (1.6 mm) internal diameter; in such a case the trash screen may be of 14 Tyler mesh. Slurry enters the tangential inlet portions 23 of the vortex finder caps 16 and is separated by means of the centrifugal action of the cyclone into an underflow, which passes down the cyclone through the apex unit 17, and an overflow which passes upwards through the vortex finder 44. The underflow contains denser particles and passes into the enclosure 8 and out through the outflow pipe 11. The overflow containing the higher proportion of carrier liquid enters the upper end closure 5 and leaves through the outlet pipe 9.

Clearance of obstructions formed at various parts of the cyclone is achieved by a sequentially timed cycle of operations as follows. After the appropriate interval of normal running of the cyclone a timer 86 initiates the following events. The plunger arrangement 25 is actuated to operate upon the linkage 24 to rotate the vertical rod 20, thus causing the prongs 21 to force through the tangential inlets 23 any large particles obstructing the inlet. These therefore pass into the conical body 15 of the cyclone and in most cases will form an obstruction in the apex unit 17. At this point in the sequence the mechanism 32 is timed to come into operation and the plate 34 is moved downwardly pushing the rods 33 through the corresponding vortex finders 44 and apex units 17, forcing the obstruction into the underflow and hence out through pipe 11.

In this way, all the particles responsible for a blockage are expelled through the underflow, where a small fraction of light particles can be tolerated in most applications. The converse, a small fraction of heavy particles in the overflow, is quite unacceptable in some applications. However, the hydrodynamic flow patterns within the cyclone are interrupted by the present clearance operation for a time which is short compared with the average residence time of a particle in the cyclone. Thus, even the clearance operation does not cause heavy particles to be expelled through the overflow, since, well before that happens, these are re-sorted as the normal flow patterns re-assert themselves in the cyclone. As an extra precaution, the timer could initiate yet a further event, viz. the actuation of valves to recirculate all the overflow back to the slurry feed for a period of, say, 2 seconds. The vertical movement of the rods 33 terminates when the pressure pads 37 abut against the upper end closure 5 and the springs 36 achieve maximum compression. The cycle of clearing operations is concluded by a resetting of the timer and retraction of the rods 33 to their original position followed by rotation of the rod 20 to remove the prongs 21 from the inlets 23. The rods 33 can be inserted and withdrawn, by hydraulic techniques, within 1 second. If, because of immovable obstruction in a cyclone, the plate 34 cannot travel its full distance, the switch on the plate 34 actuates an alarm system to warn the operator of this problem. Other arrangements for raising the alarm in the case of immovable obstructions may also be envisaged.

The above events have been described as initiated by a timer, and could conveniently be repeated, if there were no other initiator, every 5 to 120 seconds, preferably every 30 to 60 seconds. If the cycle of operations were much slower, for example every 10 minutes in some applications, a blockage could become too severe to be rodded through. On the other hand, if the cycle were much faster than, say, every 5 seconds, this would needlessly upset the proper operation of the cyclone.

However, the pressure transducer is provided to detect a drop in pressure, whose usual cause will be an apex blockage. When the transducer does so detect, it gives a signal, which also initiates these events. Although a blockage should thus have no time to become too severe to be rodded through, the alarm system described will operate if the blockage is indeed immovable. To guard against transducer failure, and as a general precaution to break up incipient deposits, the timer when used in combination with the transducer still initiates these clearing events every so often (e.g. every 1 to 10 minutes, preferably every 5 minutes).

Figure 2:
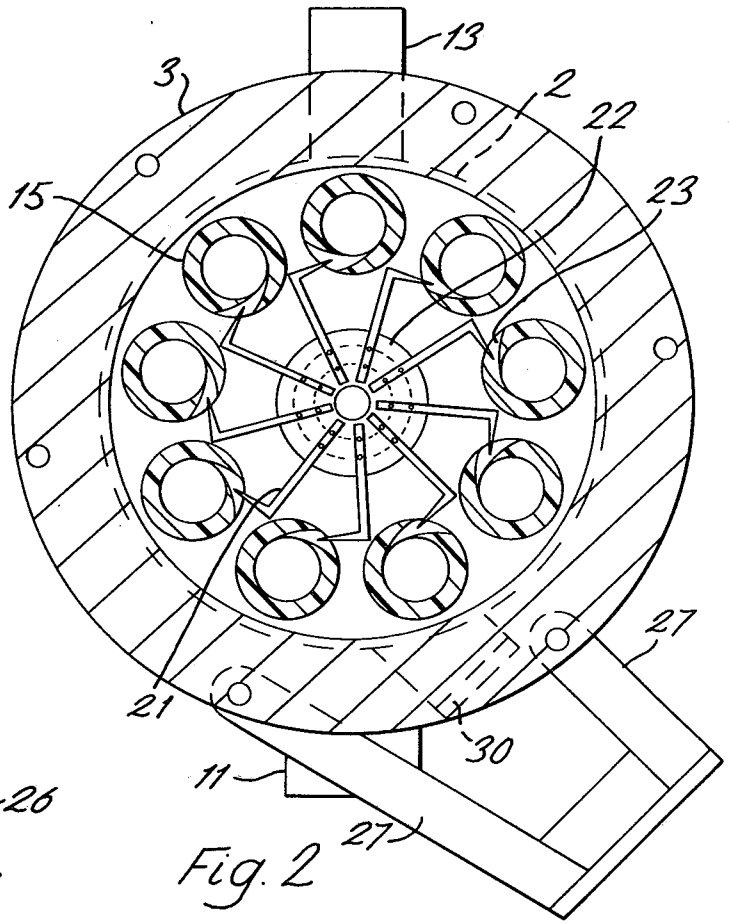
FIG. 2 is a sectional plan view of the associated clearing system located at the upper end of the general layout shown in FIG. 1.
Figure 3:
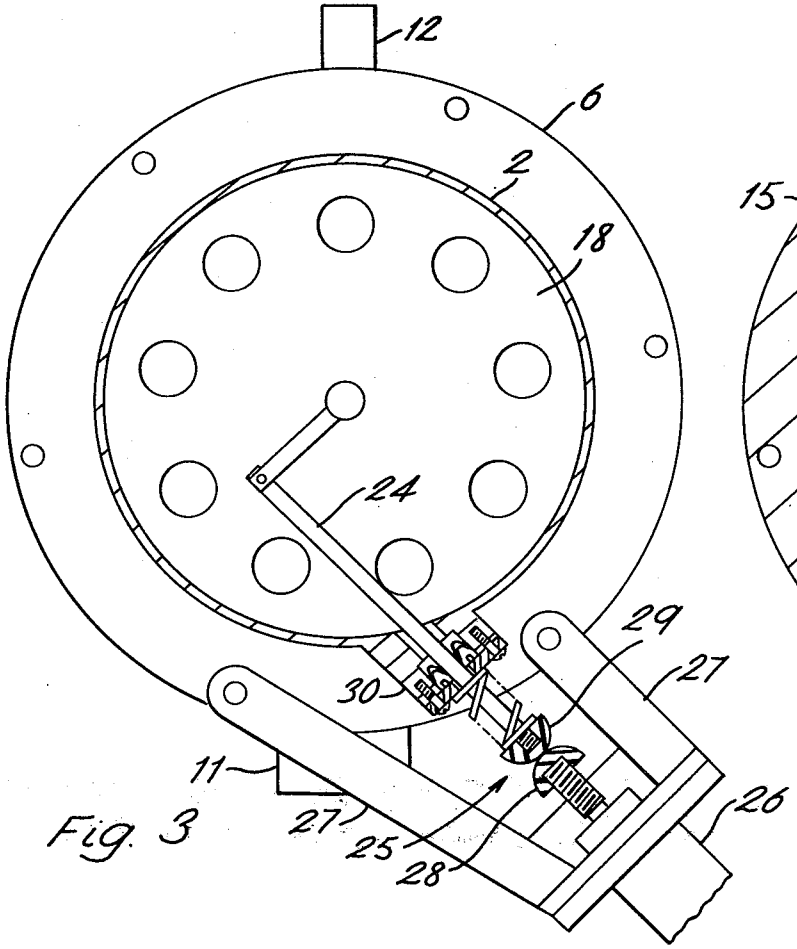
FIG. 3 is a sectional plan view partly in the section of the activating mechanism located at the lower end of the general layout view of FIG. 1.
Figure 4:
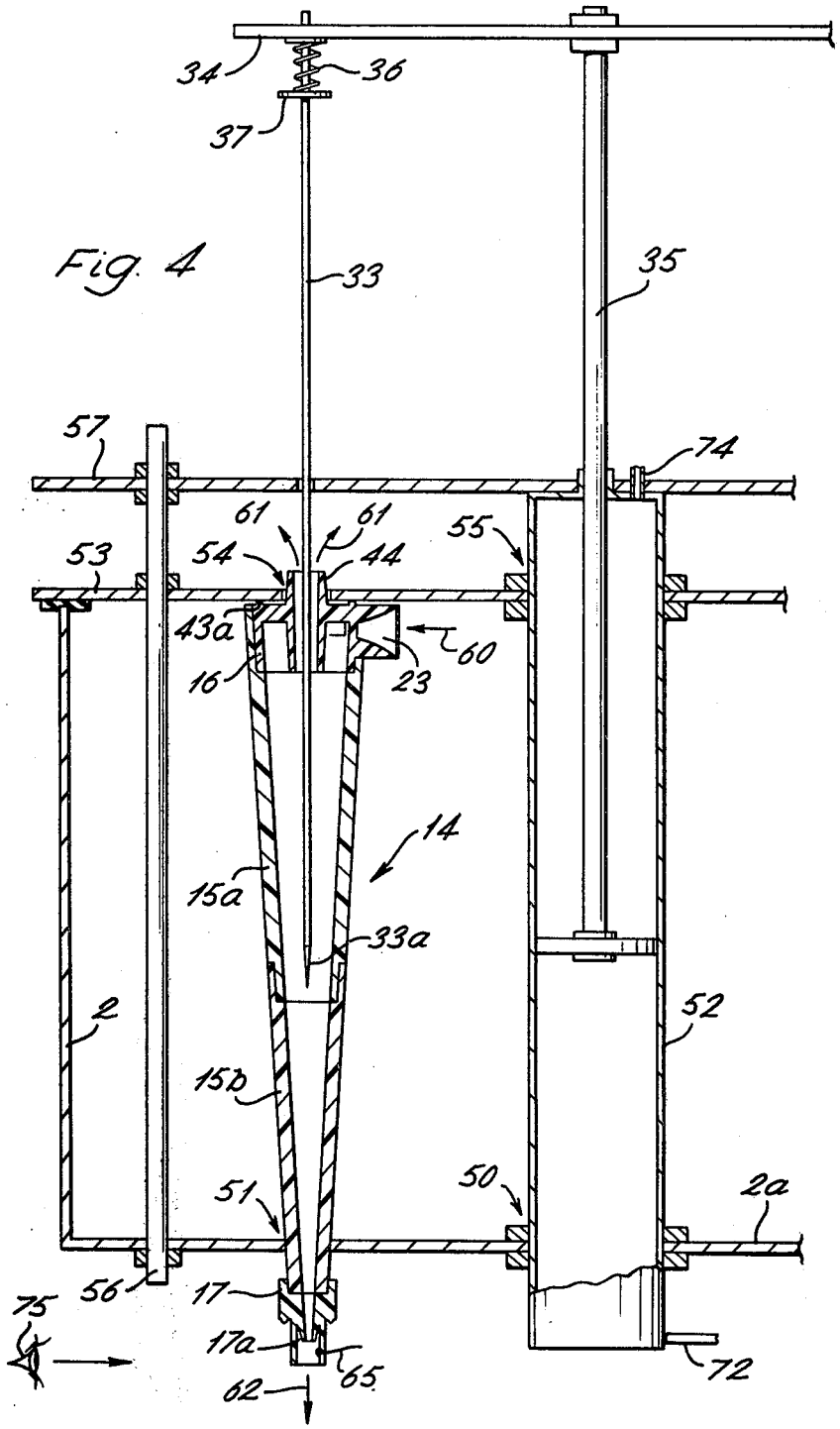
FIG. 4 is a sectional side elevation showing a cyclone separator according to the invention having a clearing system but somewhat different from FIG. 1.

Referring to FIG. 4, in which parts similar to those shown in FIGS. 1 to 3 keep the same reference numerals, a cylindrical body portion 2 integral with a base plate 2a houses eight or nine cyclones 14, only one of which is shown. The parts 2, 2a could be made of a box section or by folding stout sheet metal. The base plate is centrally apertured at 50 and has eight or nine circumferentially equally spaced apertures 51. Each aperture 51 receives a respective cyclone 14 and the aperture 50 receives a pneumatic actuating cylinder 52, which will be further described later.

Each cyclone 14 is constructed of four parts, an upper frustoconical body section 15a, a lower frustoconical body section 15b which push-fits into 15a, a vortex finder cap 16 (which three are of moulded polyurethane) and an apex unit 17. The apex unit 17 differs from the FIG. 1 version in being of polypropylene and in having an apex formed as a thin-walled, and hence slightly flexible, spigot 17a, the wall of which taper down to a fraction of a millimeter thick. The vortex finder cap 16 in this embodiment has a converging inlet 23, to modify the flow pattern of slurry entering the cyclone.

The body portion 2 has a lid or cover 53 apertured centrally at 55 to receive the cylinder 52 and at circumferential intervals 54 to receive vortex finder outlets 44 of the vortex finder caps 16 of each cyclone. The lid 53 is held closed by peripheral stays 56, for example threaded rods carrying nuts. The cyclone is held together by clamping pressure between the lid 53 and the base plate 2a. A gasket seals the body portion 2 to the lid 53, an annular rim 43a on the vortex finder caps 44 seals the apertures 54 and any suitable means, for example nuts carried on an externally threaded portion of the cylinder 52, seals the aperture 55. The stays 56 also carry, above the lid 53, a cover plate 57 abutting the top of the cylinder 52. A lined central aperture in the cover plate 57 allows a shaft or piston 35 to slide in the cylinder 52, while other apertures allow rods 33 to pass therethrough. Each rod 33 has a tapered lower end 33a which can pass into its respective spigot 17a even though, for rigidity, the remainder of the rod is too thick.

In use, the piston 35 is at rest at the top of its stroke. The rod 33 in this position is fully retracted from the cyclone 14. Matter to be sorted (conveniently in the form of a slurry) is pumped under pressure into the box formed by 2, 2a and 53 and enters the vortex finder caps 16 of the cyclones 14 as shown at 60. As explained in connection with FIG. 1, the cyclones sort the matter into an overflow, which emerges through the vortex finder 44 as shown at 61, and an underflow, which passes through the spigot 17a as shown at 62. The overflow is allowed to run out, from its collecting chamber formed by the lid 53 and cover plate 57, and is resorted, stored or disposed of, as the case may be. The underflow falls in clearly visible streams 62 one from each cyclone into drainage channels or other suitable means for transport to resorting, disposal or storage as the case may be.

Much as in FIG. 1, every 5 minutes the cylinder 52 is actuated through a control system (not shown) and pneumatic lines shown schematically as 72 and 74 to bring down the piston 35 by its full stroke. It will be seen from FIG. 4 that, in the lowermost position of the piston 35, the top of the end 33a of the rod 33 just passes through the spigot 17a, thus clearing from it any deposits or blockage. Thanks to the flexibility of the spigot 17a, slightly oversize particles of grit can be rodded through. As quickly as the pneumatics allow, the piston 35 is returned to the top of its stroke, fully retracting each rod 33 from its cyclone 14. The parts 34, 36 and 37 are as in FIG. 1, and, as in FIG. 1, failure by the piston to perform a full stroke causes the switch (not shown) on the plate 34 to raise an alarm.

The free flow of underflow as streams 62 is detected in FIG. 1 by a transducer. In FIG. 4, however, matters are arranged so that visual inspection from 75 allows the absence of any stream 62 to be noticed at a glance, there being no obstructions to a clear line of sight. Also, a thermistor 65 is provided in each apex unit 17 just downstream of the spigot 17a. The temperature of the thermistor is related to the flow of the stream 62; if this flow diminishes, the thermistor will run hotter and this is arranged to actuate the pneumatics to cause a rodding-through operation. If the obstruction in the spigot 17a cannot be rodded through, the alarm is raised and the operator can either shut down the whole bank of eight or nine cyclones 14 in the body portion 2 or can visually identify which is the blocked spigot 17a from the absence of a good stream 62, wrench off the offending apex unit 17, and push on a new apex unit 17. The thermistor 65 may be disconnected from the old apex unit and attached to the new one, or each apex unit may be supplied with a ready-fitted thermistor requiring only to be plugged into the relevant circuit.

Here, as in FIG. 1, is a parallel working cyclone system comprising eight or nine cyclones arranged with their axes parallel and having a common means to insert the rods 33 of all the cyclones. The cyclone axes, as best seen in FIG. 2, are perpendicular to a notional circle on the circumference of which all the cyclone apices lie. These common means are, in FIG. 4, the piston 35 and the cylinder 52; these two could be reversed and, more generally, 35 is a moving member carrying the rods 33 while 52 is a fixed member which guides and conveys motive power to the moving member in a direction parallel to the rods 33 i.e. parallel to the cyclone axes. 52 could even conceivably be electric or magnetic e.g. a solenoid with 35 as a moving core, such solenoid being merely a ring disposed at about the height of the lid 53 or the cover plate 57. However that may be, a major proportion of the guided part of the moving member 35, when the rods 33 are in the apex-rodding position, is disposed within the height of the cyclone separators. In the FIG. 4 embodiment, where the piston 35 moves in the fixed cylinder 52, a major proportion of the cylinder 52 is disposed within the height of the cyclone separators.

This arrangement of the cylinder 52 generally on a level with the cyclones 14 has the advantage that in the case of a cyclone 600 mm high—a convenient size in mineral processing, allowing a maximum internal diameter of about 50 mm and yet a spigot 17a of about 1.5 mm internal diameter—the maximum height required by the cyclone separator including ancillary equipment may be kept to within 2 m, and even a 900 mm or 1 m cyclone might be accommodated below a standard 2.5 m or 3 m ceiling, so that there would be no need to erect a special building.

In FIG. 1, by comparison, the cylinder (not shown) for actuating the shaft 35 could not be replaced centrally between the cyclones because of inlet rodding gear (e.g. 21, 22) located there. The cylinder could be above the section 5, but the total height of the cyclone separator including ancillary equipment would easily approach quadruple the height of the cyclone itself. This may be tolerated if the cyclone is short (e.g. 300 mm) or inlet rodding is very important, but otherwise the arrangement of FIG. 4 would be preferred, this invention thus offering a choice of arrangements according to the user's requirements.

Figure 5:
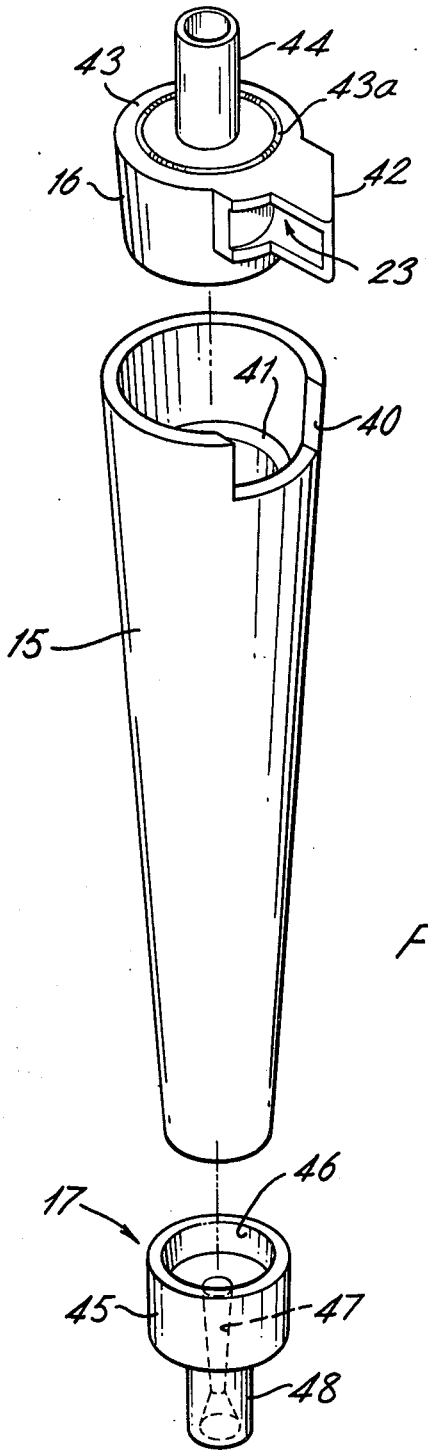
FIG. 5 shows detail views of sections of a cyclone as used in FIG. 1.

Referring now to FIG. 5, the conical body 15 of the cyclone is cut away at its upper end at recess 40 and has an internal shoulder 41 on which sits the vortex finder cap 16. The latter is generally of correspondingly conical shape but has a hollow projection 42 which comprises the inlet 23, which, as in FIG. 1 (not as in FIG. 4), is of constant height. The vortex finder cap 16 fits into the body 15 with the projection 42 fitting into the recess 40 and the upper plane surface 43 of the member 16 on a level with the upper edge of the body 15. Optionally the otherwise plane surface 43 has a raised annular bearing rim 43*a* for receiving downwards pressure on the cyclone and/or for sealing purposes, as in FIG. 4. The vortex finder cap 16 has a tubular extension 44 which locates in an aperture in the plate 19 (see FIG. 1).

The apex unit 17 has a generally cylindrical body 45 having a well 46 at its upper end into which the conical body fits. Internally the unit 17 is as in FIG. 1 (not as in FIG. 4) in having a converging then diverging passage 47 leading to the outlet in a lower tubular projection 48 which fits into the corresponding aperture in the plate 18 (see FIG. 1).

Optionally the lower surface of the body 45 has a raised annular bearing rim, or is recessed (not shown) to accommodate o-ring or other seals for fluid tight connection between the plates 18 and 19 and/or for receiving upwards pressure on the cyclone; this bearing rim or recess is thus complementary to the bearing rim 43*a*.

I claim:

1. In a cyclone separator having a vortex finder and an apex, and at least one orifice subject to blockage, the improvement comprising:

an outside-parked operative clearing member in the form of an elongated pusher rod, arranged for insertion through the vortex finder and thence through the apex; and means for temporarily inserting said clearing member into said at least one orifice for clearing said at least one orifice of blockage, thereby conducting a clearing operation;

said at least one orifice includes means defining an apex outlet of said cyclone separator;

the improvement further comprising:

a blockage sensor for detecting blockage of said apex outlet; and control means provided as part of said, temporarily inserting means and connecting the blockage sensor with the clearing member, for initiating a said clearing operation upon detection by said blockage sensor of a said blockage;

further control means provided as part of said temporarily inserting means, for automatically initiating a said clearing operation each time a preselected amount of time has elapsed.

2. A cyclone separator improvement, comprising:

a plurality of cyclone separators arranged with the respective longitudinal axes thereof parallel to one another and all perpendicular to a notional circle;

the cyclone separators each having an apex, all these apices lying on the circumference of said notional circle;

the cyclone separators each having an inlet, a vortex finder and at least one orifice subject to blockage;

there being provided for each said cyclone separator:

an outside-parked operative clearing member in the form of an elongated pusher rod, arranged for insertion through the respective vortex finder and thence through the respective apex; and there being provided for all said cyclone separators in common:

means for temporarily inserting all said clearing members into the respective said at least one orifices, jointly, for simultaneously clearing all of said at least one orifices of blockage, thereby conducting a clearing operation;

a rod having an arrangement of a plurality of clearing prongs secured thereon, the arrangement being such that the prongs are disposed in a generally circular series, swatiska-fashion;

said rod being disposed and mounted centrally of said notional circle for angular reciprocation about the longitudinal axis thereof, between a first position wherein all of said clearing prongs are withdrawn free of the respective inlets and a second position wherein all of said clearing prongs are inserted in blockage-clearing relation with the respective inlets.

3. A method for clearing out an obstruction including an incipient obstruction from blocking an orifice of a cycle separator which also has a vortex finder and an apex, comprising:

(a) parking an operative clearing member outside the cyclone separator ready for conducting a clearing operation;

(b) inserting said clearing member from outside the cyclone separator, through said vortex finder and said apex and into said orifice; then (c) withdrawing said clearing member from the cyclone separator; and (d) repeating step (a);

said method further comprising:

monitoring the extent of insertion of said clearing member in step (b); and should said extent be insufficient to correlate with successful clearing of said orifice, automatically providing an alarm signal as an indication of this insufficiency.

4. The method of claim 3, further comprising:

sensing for obstruction of said orifice and automatically initiating a clearing operation comprising conducting steps (b), (c) and (d) in sequence, upon sensing that said orifice has become obstructed.

5. The method of claim 3, further comprising:

sensing the passage of time; and (e) automatically conducting steps (b), (c) and (d) each time a preselected amount of time has passed since this step (e) last was conducted.

* * * * *